US005329709A

United States Patent [19]

Pérez et al.

[11] Patent Number: 5,329,709

[45] Date of Patent: Jul. 19, 1994

[54] STEAM IRON WITH FLUIDLY COMMUNICATED DRIP AND WEIGHTED VALVES

[75] Inventors: Augustin A. Pérez, Esplugues de Llobregat; Francesc Pons, Sant Just Desvern; Juan C. C. Sanz, Barcelona; José R. Garcia, Badalona; Miguel R. Andrés, Esplugues de Llobregat, all of Spain; Bernd Trebitz, Bad Homburg, Fed. Rep. of Germany

[73] Assignee: Braun Aktiengesellschaft, Frankfurt, Fed. Rep. of Germany

[21] Appl. No.: 964,458

[22] Filed: Oct. 21, 1992

[30] Foreign Application Priority Data

Oct. 29, 1991 [DE] Fed. Rep. of Germany ..... 4135650

[51] Int. Cl.[5] ..... D06F 75/18

[52] U.S. Cl. ..... 38/77.7; 137/45

[58] Field of Search ..... 38/77.1, 77.5, 77.7, 38/77.8, 88; 219/245, 246; 137/69, 409, 419, 421, 423, 434, 437, 450, 527.8, 534, 38, 45

[56] References Cited

U.S. PATENT DOCUMENTS

| | | | |
|---|---|---|---|
| 2,089,640 | 7/1937 | Cotterman | 137/45 |
| 2,143,701 | 1/1939 | Kelley et al. | 219/246 X |
| 2,342,653 | 2/1944 | Edwards | 38/77.7 |
| 2,384,839 | 9/1945 | Kistner | 38/77.7 |
| 2,425,598 | 8/1947 | Clum . | |
| 2,501,028 | 3/1950 | Charland . | |
| 2,581,530 | 1/1952 | Harstick | 137/534 X |
| 2,825,157 | 3/1958 | Kistner | 38/77.7 |
| 3,263,350 | 8/1966 | Abraham | 38/77.7 |
| 3,304,881 | 2/1967 | Grisé | 137/45 X |
| 4,366,367 | 12/1982 | Mazzucco | 219/245 X |
| 4,960,147 | 10/1990 | Diamond | 137/45 |
| 5,074,066 | 12/1991 | Sakano et al. | 38/77.8 |

FOREIGN PATENT DOCUMENTS

| | | | |
|---|---|---|---|
| 2442126 | 3/1975 | Fed. Rep. of Germany | 38/77.5 |
| 3607291 | 3/1986 | Fed. Rep. of Germany . | |
| 480485 | 12/1969 | Switzerland . | |
| 682970 | 11/1952 | United Kingdom . | |
| 951532 | 3/1964 | United Kingdom . | |

*Primary Examiner*—Andrew M. Falik
*Assistant Examiner*—Ismael Izaguirre
*Attorney, Agent, or Firm*—Fish & Richardson

[57] ABSTRACT

A smoothing iron has a water reservoir with a water discharge valve and drip valve. The water discharge valve includes a motion-dependent weight for inhibiting the passage of water from the water reservoir to the steam chamber of the iron when the iron is in a position of rest. When the valve is opened by the pressing motion, water is passed around the valve and through a water conduit to the drip valve which allows passage of the water to the steam chamber. To increase the degree of responsiveness of the water discharge valve, the weight is connected to a sealing body by a connecting rod.

22 Claims, 6 Drawing Sheets

STEAM IRON WITH FLUIDLY COMMUNICATED DRIP AND WEIGHTED VALVES

This invention relates to a smoothing iron.

BACKGROUND OF THE INVENTION

Smoothing irons which include a water reservoir, a drip valve and a water discharge valve are known. The water discharge valve controls the flow of water from the water reservoir which is directed to the drip valve. From DE-36 07 291 C2 a water discharge valve is known having a weight which is displaceable from its position by ironing movements and, as this occurs, operates to open and close a valve bore. On movement of the iron, the weight configured as a ball rolls away from the valve bore, releasing the passage of water to the drip valve. When the iron is not manipulated, the ball will roll back to the valve bore on an inclined plane, shutting off the passage of water. This mechanism prevents steam from being delivered during moments when the smoothing iron is not in operation.

However, it is a disadvantage in the smoothing iron disclosed in DE-36 07 291 C2 that the sensitivity of the ball within the water discharge valve is very low as regards its response to ironing movements. As a result of the reduced sensitivity, the discharge of water is affected during ironing movements. In addition, movement of the ball is impeded by the water surrounding the ball.

It is therefore an object of the present invention to provide a smoothing iron having an improved water discharge valve with a higher degree of responsiveness to ironing movements.

SUMMARY OF THE INVENTION

In accordance with the invention, the weight of the water discharge valve is connected with a sealing body by means of a connecting rod. This thus results in a sharing of the work, in contrast to prior art arrangements in which the weight and the sealing body are combined in a unitary member. The weight is optimally designed to respond to the ironing movements with a maximum of sensitivity. In addition, the connecting member connects the weight with the sealing body which serves the opening and closing functions. The connecting member acting as a lever arm, a more or lees unstable structure is provided with respect to the center of gravity when the iron is moved, thereby increasing the degree of responsiveness to ironing movements.

In a embodiment the connecting member is arranged to extend within the valve bore. The advantage of this arrangement is that the ironing movements have the simultaneous effect of dislodging mineral deposits.

By arranging the weight on the water inlet side of the valve bore and the sealing body on the water outlet side of the valve bore the connecting member may be constructed to a relatively long dimension, extending in the direction of the handle, because the iron has more free space in the direction of the handle than in the direction of the soleplate.

In another embodiment of the present invention, the weight and the sealing body are arranged on the water inlet side of the valve bore. In this embodiment, the sealing body lifts clear of the valve bore on one side, the water pressure acting additionally on the sealing body, thus exerting an additional closing force on the valve bore.

In another embodiment the weight and the sealing body are arranged on the water outlet side of the valve bore. In this embodiment, the water pressure acts additionally on the sealing body through the valve bore, enabling the valve bore to be opened more easily. Furthermore, by covering the valve bore from the water outlet side, the sealing body avoids the formation of hard water mineral deposits at these locations.

In all embodiments thus far described, the connecting rod carrying the weight and the sealing body is tiltably mounted. In accordance with a further aspect, the connecting member may be additionally supported in a fulcrum, resulting in a one-armed or a two-armed lever depending on the position of the fulcrum, with the sealing body moving along an accurately predetermined orbit. This arrangement also has the advantage of enabling the weight and the connecting member to be provided outside at a freely selectable location where free space is still available in the iron, rather than along the longitudinal axis of the valve bore. The connecting member is advantageously a connecting rod.

The movement of the water discharge valve of the invention may be supported by spring means improving the closing function materially.

If the sealing body is configured as a plate-shaped structure, a larger area can be covered to close the valve bore. This augments the sealing effect advantageously which may be additionally assisted by an elastic seal.

The movement of the weight may be limited by abutment stops using preferably the walls of the water reservoir. The abutment stops may also be provided by a tube surrounding the weight.

The water discharge valve and the drip valve are adapted to be combined to an integral unit. For this purpose, the connecting rod is preferably shaped in the manner of a tube accommodating the needle of the drip valve. With this integral structure, the weight may also be configured as a ring having a higher mass moment of inertia.

With respect to the passage of water, all embodiments are adapted to be constructed such that the drip valve and the water discharge valve are arranged in series. Depending on the structural shape of the smoothing iron and the free space available, the drip valve may be inserted upstream or downstream of the water discharge valve. Arranging the drip valve downstream of the water discharge valve allows better metering of water depending on the degree of opening of the drip valve.

BRIEF DESCRIPTION OF THE DRAWING

The present invention will now be described in more detail in the following with reference to the accompanying drawings. In the drawings.

To avoid repetitions, functionally like parts have been assigned like reference numerals throughout the Figures.

DESCRIPTION OF PARTICULAR EMBODIMENTS

Figure 1:
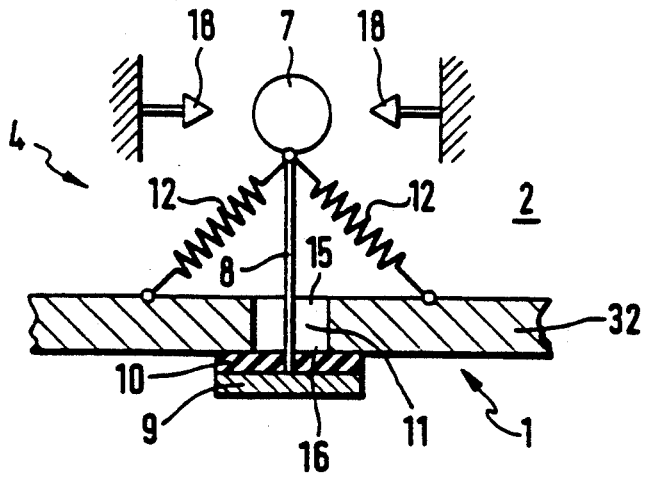
FIG. 1 is a schematic view illustrating a first embodiment of the invention.
Figure 2:
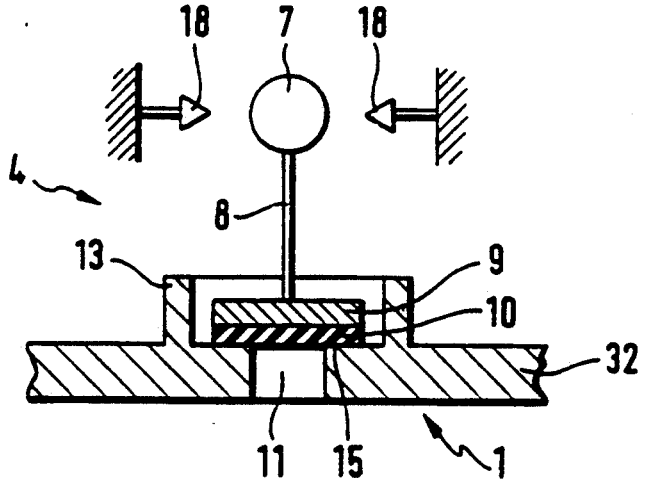
FIG. 2 is a schematic view illustrating a second embodiment of the invention.
Figure 3:
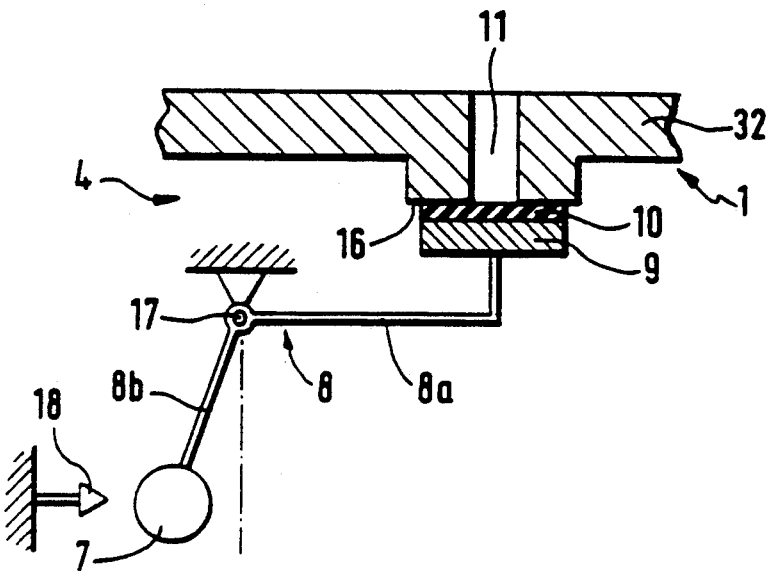
FIG. 3 is a schematic view illustrating a third embodiment of the invention.

FIGS. 1, 2 and 3 illustrate embodiments of the invention in schematic representation. The wall of a smoothing iron 1, preferably the bottom 32 of a water reservoir 2, includes a valve bore 11. In FIG. 1, the valve bore 11 receives a connecting rod 8 carrying at its upper end a weight 7 and at its lower end a sealing body 9. In all embodiments, the weight 7 may be of various shapes. For example, the weight 7 may be spherical, cylindrical, or conical.

In FIG. 1, spring means 12 are provided by way of example, which in this embodiment are compression springs urging the sealing body 9 against the wall of the smoothing iron 1 on the water outlet side 16. As shown, the sealing body 9 is preferably configured as a plate-shaped structure carrying a seal 10 which is directed towards the valve bore 11. In FIG. 1, the upper side of the wall of the smoothing iron 1 constitutes the water inlet side 15. Water is supplied from the water reservoir 2 shown in FIG. I to the water inlet side 15.

When the iron is moved, the forces resulting from the mass moment of inertia of the weight 7 will come to bear, tilting the unitary structure formed of the weight 7, the connecting rod 8 and the sealing body 9. Movement of the weight 7 which may also occur as the iron is stopped is limited, for example, by abutment stops 18. Overall, the unitary structure thus far described acts as a water discharge valve 4 opening and closing in dependence upon movements. When the iron 1 is not manipulated, the water discharge valve 4 will close, preventing water from flowing from the reservoir 2 through the valve bore 11 to a drip valve (not shown in FIG. 1). In FIG. 1, the connecting rod 8 moves within the valve bore 11, thus aiding in the dislodging of mineral residue.

In FIG. 2, the sealing body 9 is arranged on the water inlet side 15 and is guided in lateral strut members 13. In consequence, the connecting rod 8 is arranged outside the valve bore 11 which applies equally to the embodiment of FIG. 3 in which the sealing body 9 acts on the water outlet side 16.

The connecting rod 8 of FIG. 3 has the particular feature of being supported in a fulcrum 17. The support of the connecting rod 8 being illustrated in FIG. 3 by way of example, it may equally find application in FIGS. 1 and 2. In FIG. 3, the connecting rod 8 is subdivided into a lever section 8*a* and a lever section 8*b*, thus forming a two-armed lever. It will be understood that the connecting rod 8 supported in the fulcrum 17 may also be constructed as a one-armed lever, and spring means 12 may act in all embodiments. In contrast to the embodiments of FIGS. 1 and 2, the sealing body 9 of FIG. 3, rather than performing uncontrolled tilting movements, performs a circular movement pivoting about the fulcrum 17, involving a small lift necessary for unseating from the valve seat 16.

To ensure automatic closing of the valve bore 11 in FIG. 3 when it is desired to omit the spring means 12, the lever section 8*b* is positioned such that in the position of rest of the smoothing iron 1, the weight 7 acts with its own weight to urge the sealing body 9 against the valve bore 11 in closing fashion. Owing to the support of the connecting rod 8 in a fulcrum 17, a certain directional effect of the water discharge valve 4 can be accomplished. For example, the valve bore 11 would be opened if the iron were stopped subsequent to a leftward movement. Placing the iron down in vertical position would not cause opening of the water discharge valve 4 in such solutions in which the connecting rod 8 is provided with a spring arrangement 12, because the force of the spring 12 is selected such as to prevent opening of the valve 4 unless the iron 1 is moved at a slightly higher rate.

Figure 4:
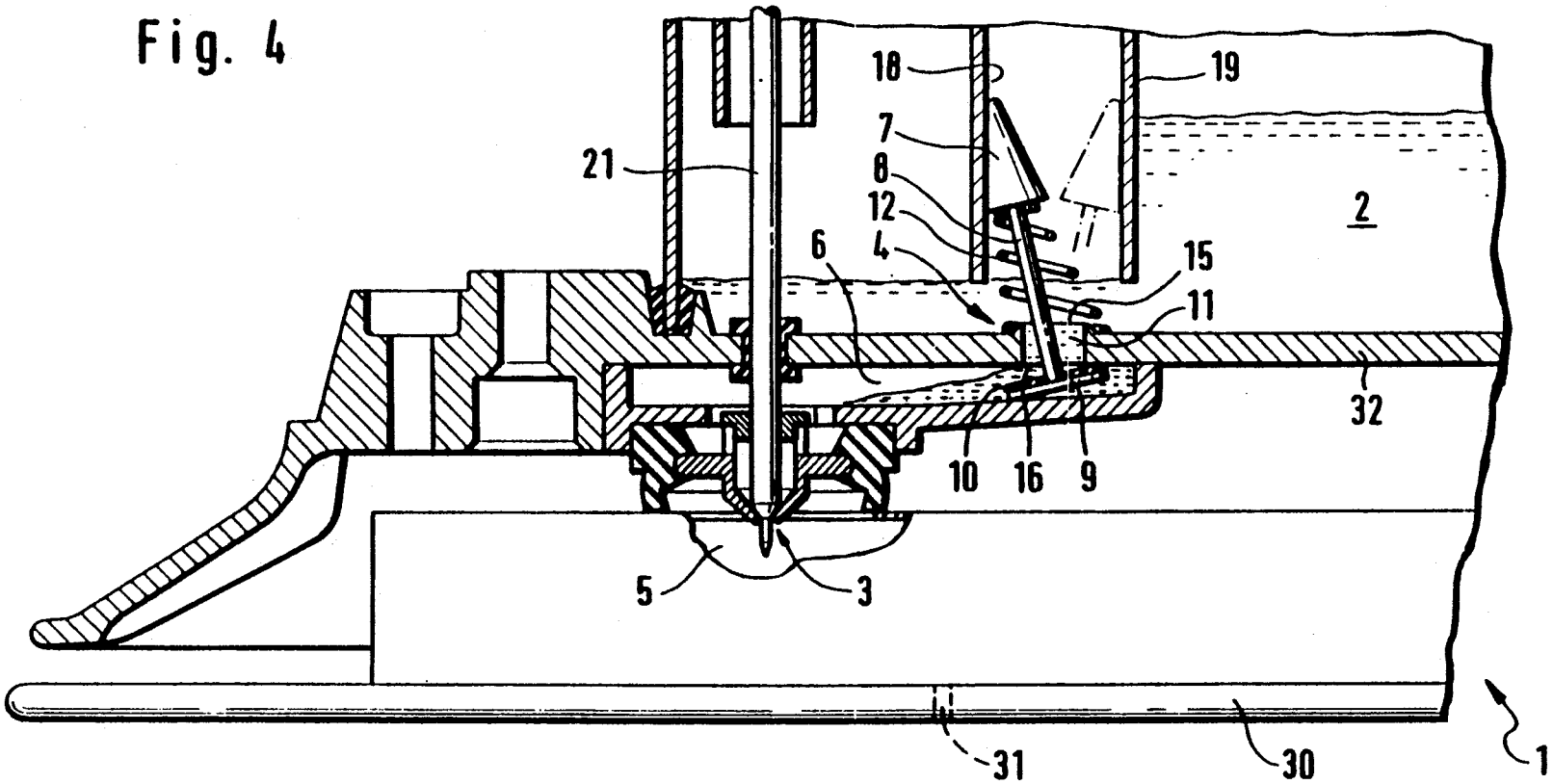
FIG. 4 is a longitudinal sectional view of a smoothing iron depicting a water discharge valve constructed in accordance with the embodiment of FIG. 1.

FIG. 4 shows a longitudinal sectional view of a smoothing iron 1 in which the water discharge valve 4 is connected to the drip valve 3 by means of a water conduit 6. In steam-generating irons of the type manufactured by the applicant, drip valves 3 of this type are comprised in the state of the art and are therefore not described in greater detail. Water is supplied from the water reservoir 2 to the valve bore 11 and is allowed to enter the water conduit 6 if the weight 7 is in the tilted position as shown. Through the drip valve 3 which is open with the valve needle 21 in the appropriate position, the water is supplied to a steam chamber 5 provided in the soleplate 30 wherefrom it is discharged through steam vents 31.

The water discharge valve 4 corresponds to the principle shown in FIG. 1 in which the sealing body 9 is arranged on the water outlet side 16 and the weight 7 is arranged on the water inlet side 15. Equally, the connecting rod 8 extends through the valve bore 11. By means of a conical compression spring 12, the seal 10 is urged into engagement with the water outlet side 16 in the position of rest of the water discharge valve 4. The weight 7 is of a conical shape dimensioned such that, when in tilted position, the entire outside width of the weight 7 is able to engage the wall of the tube 19 in the water reservoir 2, the wall serving as abutment stops 18. Owing to the conically tapering shape of the weight 7, a changed mass moment of inertia results as compared with weights 7 of other shapes, the impacts being absorbed over the entire width of the weight 7. This reduces noise because of the absence of point impact of the weight 7 on the tube 19.

Figure 5:
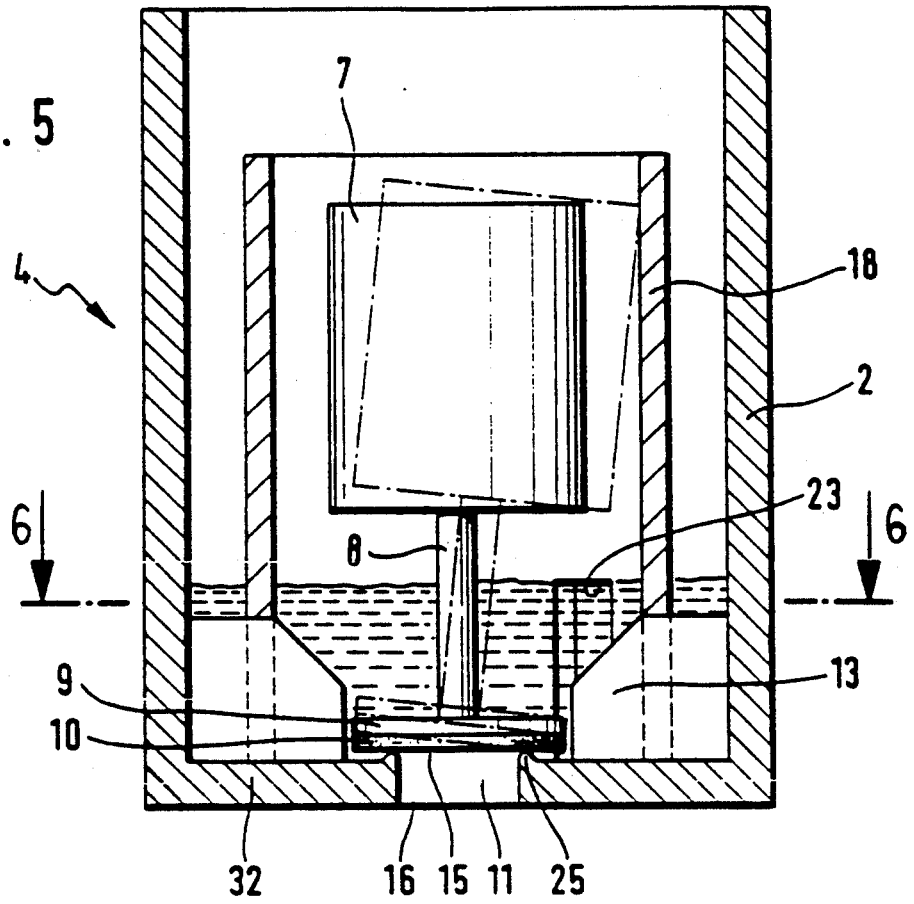
FIG. 5 is a view of an embodiment of the water discharge valve of FIG. 2.
Figure 6:
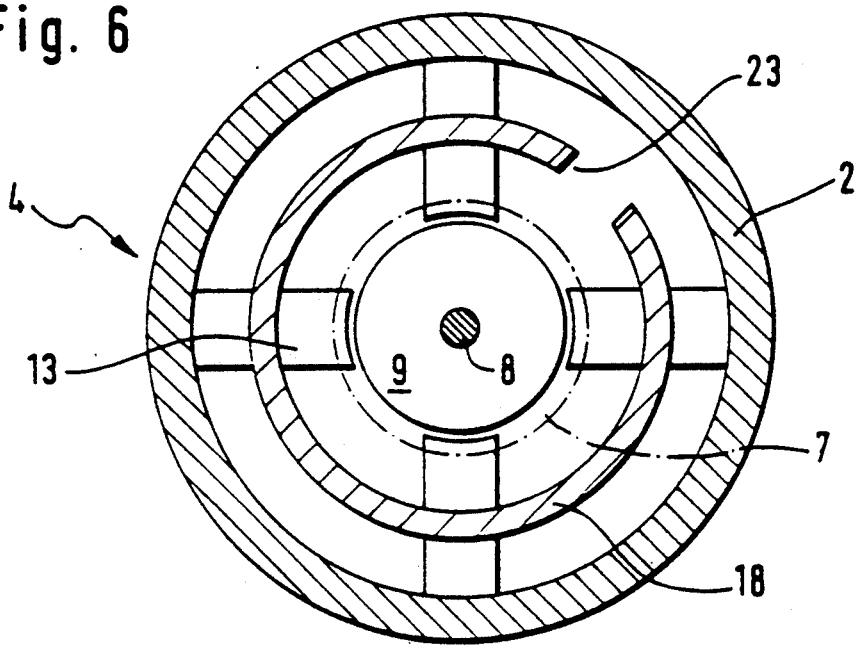
FIG. 6 is a sectional view taken along the line 6—6 of FIG. 5.

FIG. 5 shows a concrete embodiment of the water discharge valve 4 according to the principle of FIG. 2. In the position of rest, the sealing body 9 which is connected to a cylindrical weight 7 by means of the connecting rod 8 rests with its seal 10 against a small annular peripheral bead 25. The peripheral bead 25 encompasses the valve bore 11 on the water inlet side 15. Water is supplied through an inlet orifice 23 to the tubular abutment stop 18. Adjacent to the walls of the tubular abutment stop 18 whose diameter is dimensioned such as to enable the weight 7 to tilt in any direction by a predetermined degree, the plate-shaped sealing body 9 is secured by radial guide struts 13. FIG. 6 shows a section along the line 6—6 of FIG. 5, illustrating in top plan view the radial guide struts 13.

Figure 7:
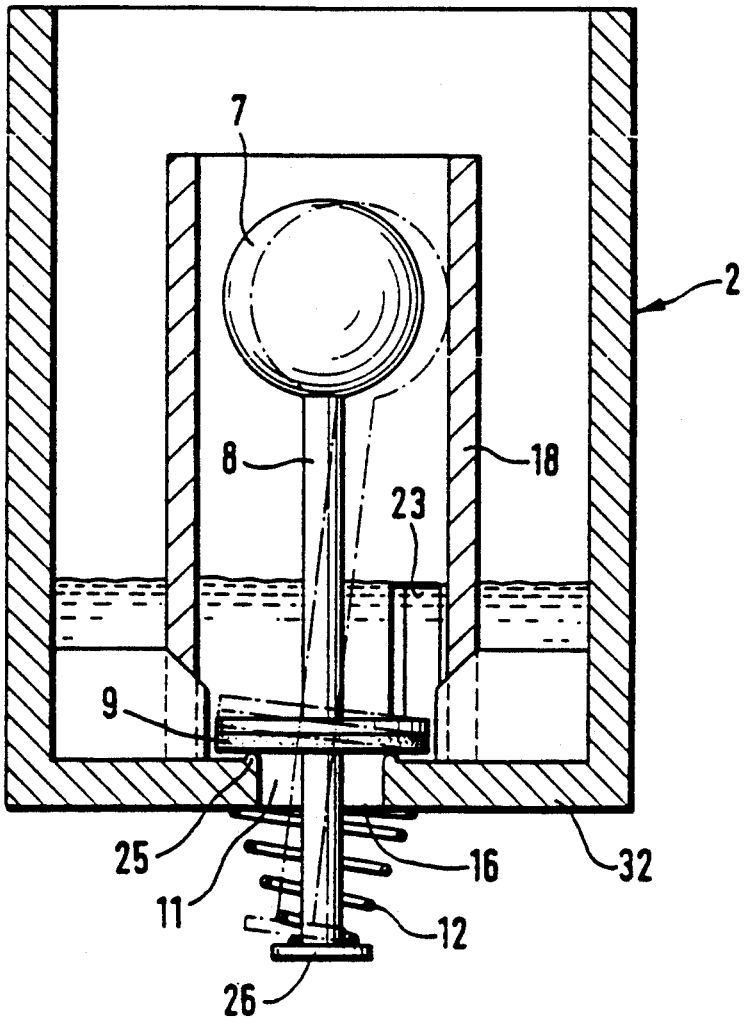
FIG. 7 is a view of a modified embodiment of the water discharge valve of FIG. 5.

FIG. 7 shows an embodiment of the water discharge valve 4 leaning upon the principle of FIG. 2 and the concrete embodiment of FIG. 5. Unlike FIG. 5, a spherical weight 7 is provided. In addition, the connecting rod 8 extends through the valve bore 11, carrying at its bottom end a plate-shaped shoulder 26. The shoulder 26 serves the function of securing the spring means 12 to the connecting rod 8. In the position of rest, the spring means 12 bearing at the same time against the bottom 32 in the area of the water outlet port 16 acts with an increased force to urge the sealing body 9 into engagement with the peripheral bead 25. Additionally, the spring 12 also acts to return the tilted sealing body 9 to the rest position. The spring means 12 thus supports the back-tilting of the weight 7 which in FIG. 5 occurs automatically, which is why the diameter of the walls of the abutment stops 18 is dimensioned such that the weight of the weight 7 produces a restoring torque for the sealing body 9. To accomplish automatic back-tilting in all embodiments which may be additionally supported by the spring means 12 as shown in FIG. 7, it is necessary for the point of gravity of the weight 7 to be not displaceable beyond the rim of the plate-shaped sealing body 9.

Figure 8:
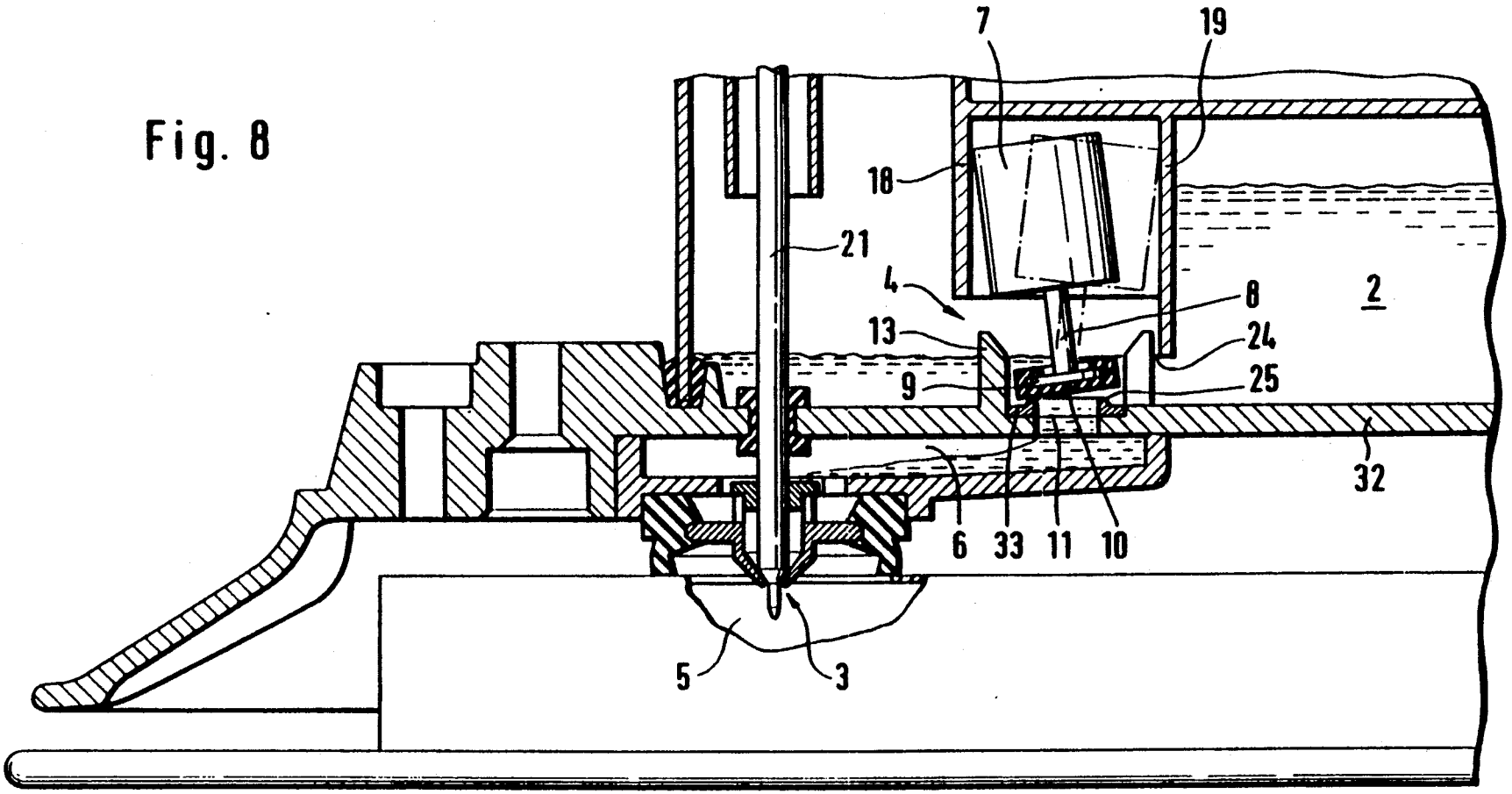
FIG. 8 is a longitudinal sectional view of a smoothing iron depicting a water discharge valve constructed in accordance with the embodiment of FIG. 2.

FIG. 8 shows a partial longitudinal sectional view of a smoothing iron 1 having a water discharge valve 4 in accordance with FIG. 2. Unlike FIG. 2, the plate-shaped sealing body 9 is completely surrounded by the seal 10. The seal 10 thus resiliently absorbs impacts occurring on the guide struts 13. Furthermore, the annular peripheral bead 25 is formed by an insertable ring 33. As in the other embodiments, the water reservoir 2, the water discharge valve 4, the water conduit 6 and the drip valve 3 are arranged in series with respect to fluid flow, with the drip valve 3 being connected downstream of the water discharge valve 4.

Figure 9:
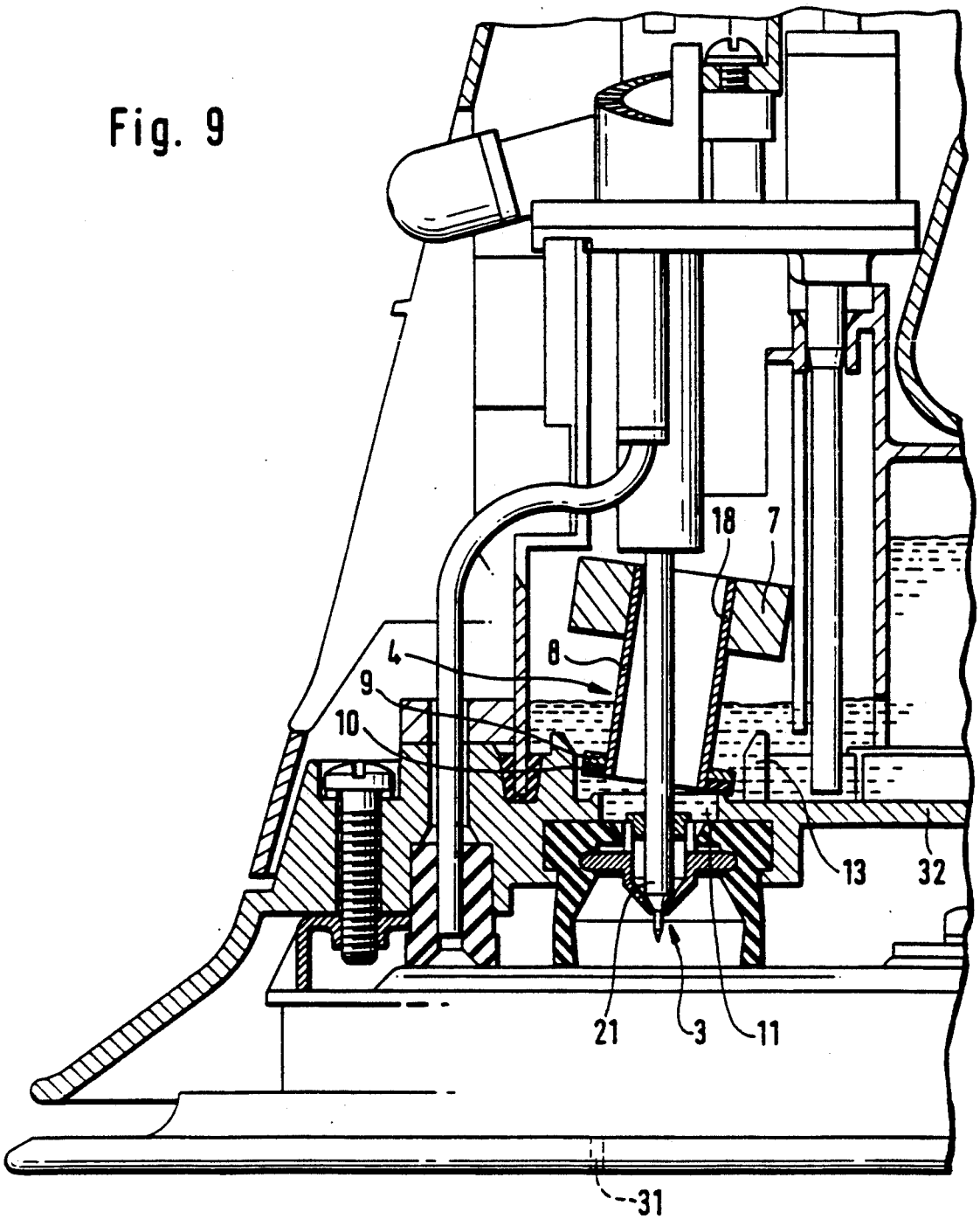
FIG. 9 is a longitudinal sectional view of a smoothing iron in which the drip valve and the water discharge valve are arranged concentrically about a valve needle.

FIG. 9 shows an embodiment in which the water discharge valve 4 is integrally formed with the drip valve 3. To this effect, the connecting rod 8 is a tube through which the needle 21 of the drip valve 3 extends. At the same time, the valve needle 21 extends through the valve bore 11 which is arranged in series upstream of the drip valve 3. The annular or plate-shaped sealing body 9 cooperates with the seal 10 to bear against the bottom end of the tube. An annular weight 7 is fastened to the top end of the tube forming the connecting rod 8. The width of the tube 8 is dimensioned to ensure sufficient opening of the valve bore 11 when the iron 1 is moved and stopped. As a result, the inner wall of the tube 8 provides the motion-limiting abutment stop 18. For example, the tube 8 may be of an oval shape having its longitudinal axis extend in the direction of the iron, causing the water discharge valve 4 to operate in dependence upon the ironing direction, that is, the water discharge valve 4 opens only when the iron 1 is moved longitudinally, remaining closed on crosswise movements.

We claim:

1. A smoothing iron having a soleplate, steam chamber structure, water reservoir structure, a water discharge valve comprising valve bore structure, a sealing body for closing said valve bore structure, a weight displaceable by ironing movements, and a connecting member connecting said weight with said sealing body and arranged within said valve bore for causing said sealing body to open and close said valve bore in dependence upon the position of said weight, a drip valve and a water conduit structure serially connecting said drip valve and said water discharge valve, said drip valve for supplying water flowed from said water reservoir structure through said water discharge valve to said steam chamber structure for discharge through said soleplate.

2. The smoothing iron of claim 1 wherein said weight is on the water inlet side of said valve bore, and said sealing body is on the water outlet side of said valve bore.

3. The smoothing iron of claim 1 wherein said connecting member is a connecting rod.

4. The smoothing iron of claim 1 wherein said sealing body is plate-shaped.

5. The smoothing iron of claim 1 wherein said sealing body includes an elastic seal.

6. The smoothing iron of claim 1 wherein said water discharge valve includes abutment stops limiting the movement of said weight during ironing movements.

7. The smoothing iron of claim 1 and further including a spring for returning said water discharge valve to a closed position.

8. The smoothing iron of claim 1 wherein said drip valve includes a valve needle that extends through said valve bore.

9. A smoothing iron having a soleplate, steam chamber structure, water reservoir structure, a water discharge valve comprising structure defining a valve bore with a water inlet side in communication with said water reservoir structure, a sealing body for closing said valve bore structure, a weight displaceable by ironing movements, said weight and said sealing body being arranged on the water inlet side of said valve bore, and a connecting member connecting said weight with said sealing body for causing said sealing body to open and close said valve bore in dependence upon the position of said weight, a drip valve and a water conduit structure serially connecting said drip valve and said water discharge valve, said drip valve for supplying water flowed from said water reservoir structure through said water discharge valve to said steam chamber structure for discharge through said soleplate.

10. The smoothing iron of claim 9 wherein said sealing body includes an elastic seal.

11. The smoothing iron of claim 10 wherein said sealing body is plate-shaped.

12. The smoothing iron of claim 11 wherein said water discharge valve includes abutment stops limiting the movement of said weight during ironing movements.

13. The smoothing iron of claim 9 and further including a spring for returning said water discharge valve to a closed position.

14. The smoothing iron of claim 13 wherein said drip valve includes a valve needle that extends through said valve bore.

15. A smoothing iron having a soleplate, steam chamber structure, water reservoir structure, a water discharge valve comprising valve bore structure, a sealing body for closing said valve bore structure, a weight displaceable by ironing movements, and a connecting member connecting said weight with said sealing body for causing said sealing body to open and close said valve bore in dependence upon the position of said weight, a spring for returning said water discharge valve to a closed position, a drip valve and a water conduit structure serially connecting said drip valve and said water discharge valve, said drip valve for supplying water flowed from said water reservoir structure through said water discharge valve to said steam chamber structure for discharge through said soleplate.

16. The smoothing iron of claim 15 wherein said sealing body includes an elastic seal.

17. The smoothing iron of claim 16 wherein said weight is on the water inlet side of said valve bore, and said sealing body is on the water outlet side of said valve bore.

18. The smoothing iron of claim 15 wherein said water discharge valve includes abutment stops limiting the movement of said weight during ironing movements.

19. The smoothing iron of claim 18 wherein said drip valve includes a valve needle that extends through said valve bore.

20. A smoothing iron having a soleplate, steam chamber structure, water reservoir structure, a water discharge valve comprising valve bore structure, a sealing body for closing said valve bore structure, a weight displaceable by ironing movements, and a connecting member connecting said weight with said sealing body for causing said sealing member to open and close said valve bore in dependence upon the position of said weight, a drip valve for supplying water from said water reservoir structure through said water discharge valve to said steam chamber structure for discharge through said soleplate, and a water conduit structure serially connecting said drip valve and said water discharge valve, said drip valve including a valve needle that extends through said valve bore.

21. The smoothing iron of claim 20 wherein said connecting member is a tube and said valve needle of said drip valve extends therethrough.

22. The smoothing iron of claim 21 wherein said weight is of ring configuration.

* * * * *